United States Patent [19]

Stitzer et al.

[11] Patent Number: 4,845,439

[45] Date of Patent: Jul. 4, 1989

[54] FREQUENCY SELECTIVE LIMITING DEVICE

[75] Inventors: Steven N. Stitzer, Ellicott City, Md.; John D. Adam, Murrysville, Pa.; Gerald I. Klein, Baltimore, Md.

[73] Assignee: Westinghouse Electric Corp., Pittsburgh, Pa.

[21] Appl. No.: 169,926

[22] Filed: Mar. 18, 1988

[51] Int. Cl.[4] ..... H01P 1/218; H01P 1/23

[52] U.S. Cl. ..... 333/17.2; 333/24.2

[58] Field of Search ..... 333/17 L, 24.1, 24.2, 333/81 A; 29/600

[56] References Cited

U.S. PATENT DOCUMENTS

| | | | |
|---|---|---|---|
| 3,317,863 | 5/1967 | Ngo | 333/24.2 X |
| 3,534,299 | 10/1970 | Eberhardt | 333/24.2 |
| 4,511,865 | 4/1985 | Dixon, Jr. | 333/17 L |
| 4,547,754 | 10/1985 | Murakami et al. | 333/24.1 X |

OTHER PUBLICATIONS

"Frequency Selective Microwave Power Limiting in Thin YIG Films," *IEEE Transactions on Magnetics*, vol. MAG-19, No. 5, Sept. 1983, Steven N. Stitzer, pp. 1874–1876.

"A Multi-Octave Frequency Selective Limiter," 1983 *IEEE MTT-S Digest*, pp. 326–328, Steven N. Stitzer and Harry Goldie.

"Non-Linear Microwave Signal-Processing Devices Using Thin Ferrimagnetic Films," *Circuits Systems Signal Process*, vol. 4, No. 1–2, 1985, pp. 227–252 Steven N. Stitzer and Peter R. Emtage.

*Primary Examiner*—Paul Gensler

*Attorney, Agent, or Firm*—Joseph C. Spadacene

[57] ABSTRACT

A frequency selective limiting device is described incorporating a plurality of individual attenuating units spaced apart from one another in substantially parallel relation and positioned between a pair of ground planes. Each individual attenuating unit is interposed between a pair of magnetic strips. In one embodiment of the invention, each individual attenuating unit includes a microstrip conductor positioned between a dielectric substrate layer and a layer of ferrite material. In an alternate embodiment of the invention, each individual attenuating unit includes a microstrip conductor positioned between a pair of planar ferrite members, the pair of ferrite members and microstrip conductor being mechanically supported by a dielectrical substrate layer. In both embodiments of the invention, adjacent attenuating units are serially connected by microstrip jumpers to provide a flow path for microwave signals passed through the limiting device. The plurality of ferrite members in association with the plurality of magnetic strips are operable to attenuate by a predetermined level a microwave signal above a preselected threshold power level passed through the limiting device.

20 Claims, 5 Drawing Sheets

FREQUENCY SELECTIVE LIMITING DEVICE

BACKGROUND OF THE INVENTION

1. Field of the Invention

This invention relates to an attenuating device, and more particularly, to a device which utilizes a YIG material to provide frequency selective attenuation of microwave signals above a preselected threshold power level.

2. Description of the Prior Art

Frequency selective limiting (FSL) or attenuating devices which utilize a yttrium-iron-garnet (YIG) material have the property of being able to attenuate higher power level signals while simultaneously allowing lower power level signals separated by only a small frequency offset from the higher level signals to pass with relatively low loss. YIG-based FSL's are capable of limiting or attenuating across more than an octave bandwidth in the 2–8 GHz range. Higher power level (above-threshold) signals within this selectivity bandwidth will be attenuated without requiring tuning of the FSL. Lower power level (below-threshold) signals separated from the higher power level signals by more than a few spinwave linewidths will pass through the FSL without experiencing any greater loss than if the higher power level signals were not present. For an attenuating device based on YIG, this selectivity bandwidth is on the order of between 20–50 MHz.

YIG-based FSL's have many applications in microwave signal systems, one such application being illustrated in FIG. 1. As seen in FIG. 1, the microwave signal system 10 includes an antenna 12 for collecting and passing microwave signals to a broadband-type receiver 14. The microwave signal system 10 also includes a YIG-based FSL device generally designated by the numeral 16 interposed between antenna 12 and broadband-type receiver 14.

FSL 16 is utilized as illustrated in FIG. 1 to increase the dynamic range over which microwave signals collected by antenna 12 can be measured by broadband-type receiver 14. These microwave signals measured by receiver 14 may thereafter be supplied to processor 17, or to any other suitable device. Since known receivers such as broadband-type receiver 14 generally have a dynamic range of approximately 35 dB, and signals of interest arriving at antenna 12 may have a dynamic range of, for example, 85 dB, it is seen that a power mismatch is created within system 10. This mismatch in dynamic ranges between signals arriving at antenna 12 and broadband-type receiver 14 may be corrected by utilizing an attenuation device such as FSL device 16. If, as previously stated, the dynamic range of signals arriving at antenna 12 is 85 dB and the dynamic range of broadband-type receiver 14 is 35 dB, then FSL 16 will be designed to provide a dynamic range of approximately 50 dB. In this manner, the total dynamic range of FSL device 16 and broadband-type receiver 14 is matched with the dynamic range of signals at antenna 12. FSL device 16 is designed to provide that the ratio of power out to power in ($P_{out}/P_{in}$) below a predetermined threshold value of $P_{in}$ is substantially linear. As the value of $P_{in}$ seen by FSL device 16 increases above the predetermined threshold value of $P_{in}$, the ratio of $P_{out}/P_{in}$ becomes compressed. The compression of this ratio indicates that, for substantial increases in the value of $P_{in}$ above the threshold value of $P_{in}$, the corresponding value of $P_{out}$ is relatively small. For example, FSL 16 may be designed to provide that, for a 50 db increase in $P_{in}$ above the threshold power level of $P_{in}$, the corresponding increase in the level of $P_{out}$ above the level of $P_{out}$ at threshold $P_{in}$ would be approximately 5 db. Stated in another manner, FSL 16 operates to attenuate an above-threshold, input microwave signal having a dynamic range of 50 db to provide an output signal having a dynamic range of 5 db.

Although FSL device 16 described in FIG. 1 provides satisfactory above-threshold signal attenuation, the construction of FSL device 16 results in a relatively low level of above-threshold attenuation per unit length of the device. This requires meandering of the signal-carrying conductor which forms a part of the device over a relatively extended distance in order to develop adequate limiting.

YIG-based frequency selective limiting devices have heretofore been constructed using: single crystal YIG bars arrayed along a sidewall of a rectangular waveguide, YIG spheres in stripline and coaxial structures, and thin YIG plates or slabs in microstrip structures.

With each of the above-described YIG-based FSL's it has been found that the amount of level of signal attenuation capable of being achieved at a given power level above a threshold power level is proportional to the volume of ferrite or YIG material coupled to the RF field generated as the signal is passed through the FSL. In these known YIG-based FSL's, the configuration of the YIG material and the positioning of the YIG material relative to the signal-carrying conductor results in the majority of the RF field lines generated by a microwave signal flowing through the conductor to pass through regions not filled with YIG material. These generated RF field lines do not interact with the YIG material and as a result contribute nothing to the attenuation of the above-threshold microwave signal.

Therefore, there is a need for an improved YIG-based frequency selective limiting device in which the YIG material is arranged to provide maximum interaction with RF field lines generated by a microwave signal passed through the signal-carrying conductor of the device to maximize the limiting or attenuation of an above-threshold signal for a given length of conductor. The device must be capable of attenuating microwave signals having a power level above a preselected threshold power level while allowing microwave signals below the threshold power level to pass substantially undisturbed.

Accordingly, the principal object of the present invention is to provide an improved ferrite-based frequency selective limiting or attenuating device capable of providing a greater degree of above-threshold signal attenuation than ferrite-based attenuators presently utilized.

It is a further object of the present invention to provide a frequency selective limiting device which includes a plurality of individual ferrite-based limiting or attenuating units each interposed between a pair of magnetic strips which provide a DC bias field for the ferrite.

It is yet another object of the present invention to provide a method for making an individual ferrite-based limiting or attenuating unit which forms a part of an improved multi-unit frequency selective limiting device.

These and other objects of the present invention will be more completely disclosed and described in the following description, the accompanying drawings and the appended claims.

SUMMARY OF THE INVENTION

An apparatus for attenuating microwave signals above a preselected power level passed therethrough includes a plurality of spaced-apart signal-carrying conductors positioned between a pair of ground planes. The plurality of signal-carrying conductors lie along an axis substantially parallel with the pair of ground planes. A plurality of generally planar ferrite members are positioned between the pair of ground planes with at least one ferrite member being secured to one signal-carrying conductor to form a plurality of individual attenuating units. A plurality of magnetic strips are positioned between the pair of ground planes and are arranged so that an individual attenuating unit is interposed between a pair of adjacent magnetic strips. The plurality of ferrite members in association with the magnetic strips are operable to attenuate by a predetermined level a microwave signal above a preselected threshold power level passed through the plurality of signal-carrying conductors.

Additionally, in accordance with the present invention, there is provided a frequency selective limiting unit for attenuating microwave signals above a preselected power level which includes a signal-carrying conductor for passing a microwave signal therethrough, the conductor having a pair of end portions and a body portion intermediate the end portions. A ferrite covering is positioned in surrounding relation with at least the body portion of the signal-carrying conductor, and RF shielding means surrounds at least a portion of the ferrite covering. The signal-carrying conductor and the ferrite covering are adapted to be positioned in preselected spatial relation with a DC magnet means, the DC magnet means providing the ferrite covering with an external DC biasing magnetic field. The ferrite covering in association with the DC magnet means is operable to attenuate by a predetermined level a microwave signal above a preselected power level passed through the signal-carrying conductor between its end portions.

Further, in accordance with the present invention, there is provided a method for assembling a frequency selective limiting unit operable in association with an external DC biasing means to attenuate microwave signals above a preselected power level which includes the step of securing a generally planar, first ferrite member to a metallized surface of a substrate layer. A signal-carrying conductor is positioned on the generally planar first ferrite member, and a generally planar second ferrite member is placed in abutting contact with the signal-carrying conductor so that at least a portion of the signal-carrying conductor is interposed between the first and second planar members. The method includes the further step of metallizing at least a portion of an outer surface of the first and second ferrite members to enclose these respective outer surface portions in an RF shield.

DESCRIPTION OF THE PREFERRED EMBODIMENTS

In accordance with the present invention, there is provided a YIG-based FSL device having a configuration which provides an increased per unit length level of attenuation of above-threshold microwave signals over YIG-based or other frequency selective limiters heretofore utilized.

The theory of operation and the construction of known frequency selective limiting devices which utilize a YIG material are described in the following articles, which are incorporated by reference herein: "Frequency Selective Microwave Power Limiting in Thin YIG Films," *IEEE Transactions on Magnetics,* VOL. MAG-19, No. 5, September 1983, Steven N. Stitzer; "A Multi-Octave Frequency Selective Limiter," 1983 *IEEE MTT-S Digest,* page 326, Steven N. Stitzer and Harry Goldie; "Non-Linear Microwave Signal - Processing Devices Using Thin Ferrimagnetic Films," *Circuits Systems Signal Process,* Vol. 4, No. 1–2, 1985, page 227, Steven N. Stitzer and Peter R. Emtage.

Figure 1:
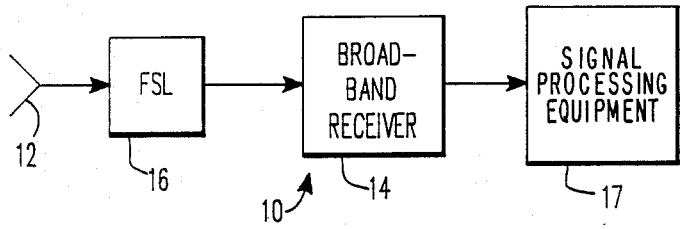
FIG. 1 provides an example in block diagram form of the type of microwave circuit in which the frequency selective limiting device of the present invention may be utilized.
Figure 2D:
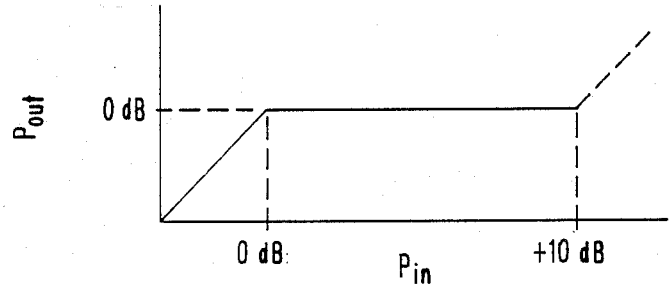
FIG. 2D is a graphic representation of an example of the dynamic range of a single attenuating unit of the present invention.
Figure 2E:
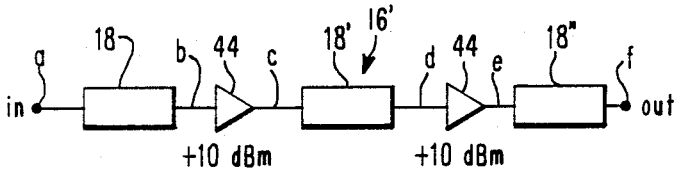
FIG. 2E is a schematic diagram of three individual attenuating units of the present invention separated by amplifier units.
Figure 2A:
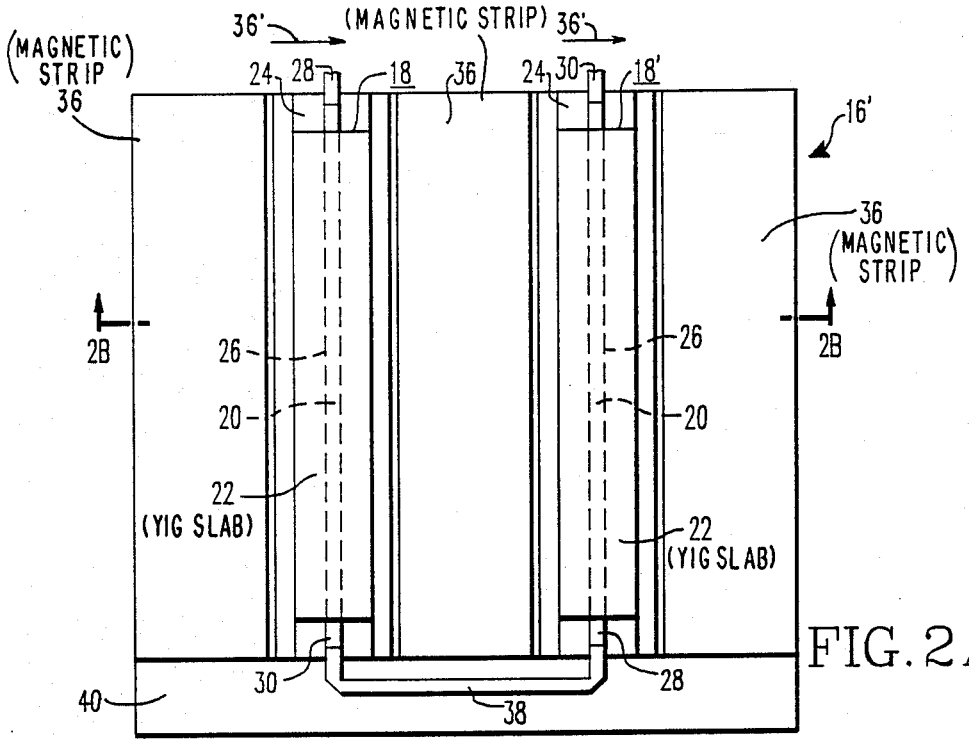
FIG. 2A is a top plan view of the frequency selective limiting device of the present invention, illustrating one embodiment of a frequency selective limiting unit, and a pair of these individual frequency selective limiting units interposed between pairs of magnetic strips.
Figure 2B:
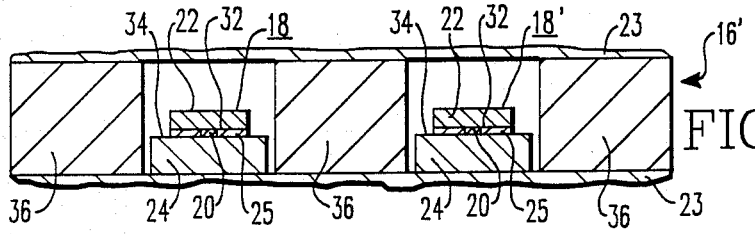
FIG. 2B is a sectional view in side elevation taken along line 2B—2B of FIG. 2A.

Referring to FIGS. 2A and 2B, there is illustrated an improved FSL device 16' for providing an increased level of attenuation of microwave signals above a preselected threshold power level passed therethrough which includes a pair of attenuating units generally designated by the numerals 18, 18'. The construction of the pair of attenuating units 18, 18' is identical, and therefore like components in each unit shall be designated by the same numerals. The attenuating units 18, 18' each include a signal-carrying conductor 20 of predetermined length positioned between a layer of ferrite material 22 and a layer of substrate material 24. The ferrite material 22 is a YIG material having a generally planar configuration. As known in the art, YIG material 22 may be grown on a nonmagnetic substrate such as gadolinium-gallium-garnet (GGG) (not shown) and thereafter the GGG material ground off to provide a YIG slab. The substrate layer 24 illustrated in FIGS. 2A and 2B is also formed from GGG material, and is utilized to provide mechanical support for both YIG slab 22 and signal-carrying conductor 20. It should be pointed out that although substrate layer 24 is illustrated and described herein as being formed from a GGG material, other suitable materials may be utilized in forming the substrate layer. However, the material from which substrate layer 24 is formed should be selected to have a thermal expansion coefficient (TEC) which approximates that of YIG slab 22. For example, a high nickel alloy (70% Ni, 17% Mo, 7% Cr, 6% Fe), which has substantially the same TEC of YIG ($\Delta L/L = 10.4 \times 10^{-6}/°$ C.) may be utilized if desired.

As seen in FIG. 2A, each signal-carrying conductor 20 includes a body portion 26 (illustrated in phantom) which is positioned between YIG slab 22 and substrate layer 24. In addition, each conductor 20 has a pair of inlet and outlet end portions 28, 30 which extend outwardly from body portion 26. Signal-carrying conductor 20 is made from a gold or other suitable material, and may be formed on substrate layer 24 by photolithographic methods known in the art. If desired, conductor 20 may be made by stretching a gold bond wire or ribbon across substrate layer 24 before YIG slab 22 is bonded thereto. It should be understood that since signal-carrying conductor 20 has a non-zero thickness, there is a small gap between YIG slab 22 and substrate layer 24, as seen in FIG. 2B. If conductor 20 is formed on substrate layer 24 by a photolithographic process, then the gap between YIG slab 22 and substrate 24 will be filled with a suitable bonding material 25. In order to eliminate this gap, a channel or groove (not shown) can be etched in the surface 34 of substrate layer 24 using a known material such as phosphoric acid. The groove can thereafter be metallized to form signal-carrying conductor 20, or a suitable gold bond wire or ribbon can be laid in the groove to permit YIG slab 22 surface 32 to directly contact substrate layer 24 surface 34.

As seen in FIGS. 2A and 2B, the attenuating units 18, 18' of FSL device 16' are each interposed between a pair of magnetic strips 36. As described, FSL device 16' is formed of an alternating series of magnetic strips 36 and attenuating units 18, 18'. As known in the art, a DC bias field for each YIG slab 22, indicated by the directional arrows 36', is required to permit operation of the YIG material to attenuate microwave signals above a preselected threshold power level passed through each signal-carrying conductor 20. It has been found that the DC bias field required for an S-band FSL assembly is in the range of between 100 to 350 gauss. Each magnetic strip 36 provides a portion of the required DC bias field for a YIG slab 22 positioned on either side thereof. As further seen in FIG. 2B, FSL device 16' includes a pair of substantially parallel, spaced-apart ground planes generally designated by the numerals 23. The attenuating units 18, 18' and magnetic strips 36 are positioned between these ground planes 23, and the ground planes act to shield FSL device 16' from other components utilized in microwave signal receiving and processing system 10.

Although FSL device 16' is illustrated in Figs. 2A and 2B as including a pair of attenuating units 18, 18' each interposed between a pair of magnetic strips 36, it should be understood that the number of attenuating units utilized is dependent upon the total level of above-threshold signal attenuation required of FSL device 16'. Since each of the attenuating units 18, 18' is capable of attenuating or reducing by a fixed db level the above-threshold signal, the total number of attenuating units utilized is a function of the desired overall level of signal attenuation. For example, if each attenuating unit is designed to provide 10 db of attenuation and the overall level of attenuation of the above-threshold signal is 30 db, then FSL device 16' will include three attenuating units such as 18, 18'.

Figure 2C:
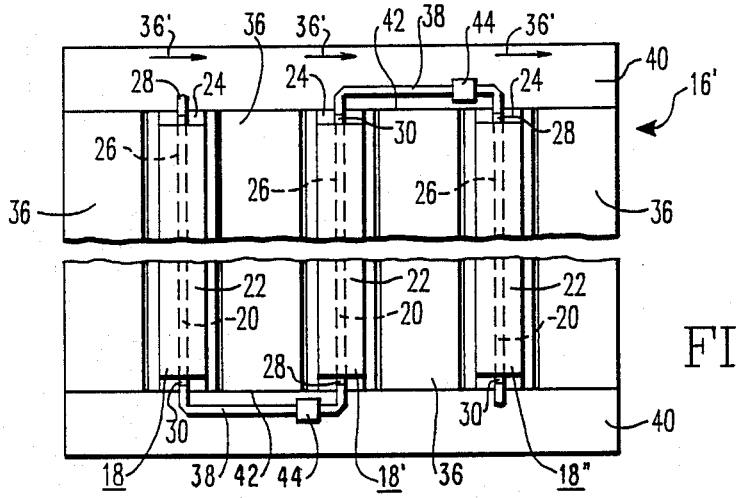
FIG. 2C is a fragmentary, top plan view of the frequency selective limiting device of the present invention, illustrating a plurality of individual frequency selective limiting units serially connected by signal-carrying jumpers and amplifier units, and separated by magnetic strips.

An FSL device 16' which utilizes three individual attenuating units 18, 18', 18'' is illustrated in FIG. 2C. Each of the attenuating units 18, 18', 18'' has the identical configuration. As seen, this FSL device includes the magnetic strips 36 previously described, and each of the attenuating units 18, 18', 18'' is interposed between a pair of magnetic strips.

As previously described, the signal-carrying conductor 20 of each of the attenuating units 18, 18', 18'' includes a body portion 26 (illustrated in phantom) and a pair of inlet and outlet end portions 28, 30. As seen in FIGS. 2A and 2C, a signal-carrying jumper 38 is connected between the conductor 20 outlet end portion 30 of one attenuating unit and the conductor 20 inlet end portion 28 of an adjacent attenuating unit to connect the plurality of attenuating units 18, 18', 18'' in serial fashion. A microwave signal received by antenna 12 enters FSL device 16' at attenuating unit 18 conductor 20 inlet end portion 28. The signal is passed through the plurality of serially connected attenuating units 18, 18', 18'' to exit attenuating unit 18'' at conductor 20 outlet end portion 30. Although not specifically illustrated in the Figures, it should be understood that if additional attenuating units are utilized, a signal-carrying jumper such as jumper 38 is connected between adjacent attenuating units to provide a serial path for a microwave signal passed through FSL device 16'. Additional attenuating units, as previously described, are interposed between pairs of adjacent magnetic strips 36.

The magnetic strips 36 positioned between adjacent attenuating sections 18, 18', 18'' are preferably either electrically conductive magnets or metallized non-conductive magnets. It has been found that these types of magnets will act as RF shields between adjacent attenuating units 18, 18', 18''.

Utilizing magnetic strips which provide the DC bias field (indicated by the directional arrows 36') required for attenuation and also serve as RF shields permit the overall dimensions of FSL device 16' to be reduced without causing undesired coupling between adjacent attenuating units 18, 18', 18''.

As further seen in FIGS. 2A and 2C, each signal-carrying jumper 38 is supported on a substrate layer 40 made from a dielectric material. The dielectric substrate layer 40 carries each jumper 38 around an end portion 42 of each magnetic strip 36. Substrate layer 40 is made from a dielectric material to prevent generation of magnetostatic surface waves which would occur if the substrate layer was made from YIG material, since magnetostatic surface waves can be generated in portions of a YIG layer if the DC bias field is parallel to the microstrip.

Referring to FIG. 2C, an amplifier generally designated by the numeral 44 may be serially connected with one or more jumpers 38, if desired, to compensate for power losses in each of the attenuating units 18, 18', 18''.

As previously described, the plurality of attenuating units 18, 18', 18'' in FSL device 16' are operable to attenuate a signal at a given microwave frequency which has a power level above a predetermined threshold power level. Since the attenuating units 18, 18', 18'' of FSL device 16' are serially connected, the conductive, dielectric and magnetic losses experienced by the microwave signal as the signal is passed through the serially connected conductors are cumulative. In order to compensate for the effects of these conductive, dielectric and magnetic losses, an amplifier such as amplifier 44 (GaAs monolithic amplifier, for example) may be serially connected with one or more of the jumpers 38 to minimize the effects of these losses.

In addition to compensating for conductor losses, the use of an amplifier 44 between adjacent attenuating units allows a plurality of attenuating units, each with identical characteristics, e.g., 0 dBm threshold and 10 dBm dynamic range to be used to cover a much larger dynamic range. The plot of $P_{in}$ versus $P_{out}$ for a single attenuating unit 18 having a 10 dBm dynamic range is illustrated in FIG. 2D. As seen, for a value of $P_{in}$ falling between 0 and +10 dBm, the value of $P_{out}$ remains 0 dBm. It can be seen that by placing +10 dB amplifiers 44 between the attenuating units 18, 18', 18'' as illustrated in FIG. 2E, the dynamic range of FSL device 16' is increased between input terminal and a output terminal f by the values listed in Table 1 below. For example, a −30 dBm signal provided to FSL device 16' at input terminal a is increased to −10 dBm at output terminal f by the pair of amplifiers 44.

TABLE 1

| POWER LEVEL (dBm) | | | | | |
|---|---|---|---|---|---|
| a | b | c | d | e | f |
| −30 | −30 | −20 | −20 | −10 | −10 |
| −20 | −20 | −10 | −10 | 0 | 0 |
| −10 | −10 | 0 | 0 | +10 | 0 |
| 0 | 0 | +10 | 0 | +10 | 0 |
| +10 | 0 | +10 | 0 | +10 | 0 |

As described, the FSL devices illustrated in FIGS. 2A through 2C are operable to pass microwave signals therethrough which have a power level below a preselected threshold power level, and also attenuate by a predetermined level those microwave signals having a power level above the preselected threshold power level. The advantages of the Frequency Selective Limiting device described herein over Frequency Selective Limiting devices heretofore utilized lies in the specific construction of the FSL assembly which provides maximum interaction between the YIG material and the RF field lines generated as the microwave signal is passed through an individual conductor. This arrangement provides a greater level of dB attenuation per unit length of signal-carrying conductor over previously used YIG-based attenuating devices. The unique construction of FSL device 16' illustrated in FIGS. 2A–2C provides a compact, lightweight microwave signal attenuating device which may be used in a variety of microwave signal processing applications.

Figure 4J:
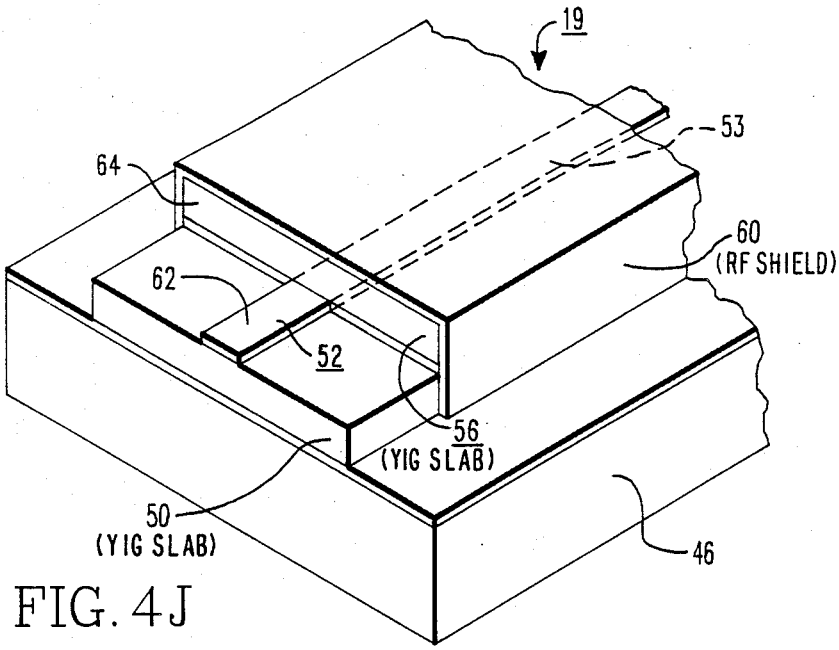
FIG. 4J is a perspective view of a portion of the assembled frequency selective limiting unit of FIGS. 4A–4I.

Now referring to FIGS. 4A through 4J, and particularly FIG. 4J, there is illustrated an alternate embodiment of attenuating unit 18 generally designated by the numeral 19. FIGS. 4A through 4I illustrate the preferred steps in forming the attenuating unit 19, and FIG. 4J is a perspective view of a portion of the attenuating unit after assembly. Although not specifically illustrated in the Figures, it should be understood that the attenuating unit 19 illustrated in FIG. 4J may replace either attenuating unit 18, 18' or 18'' illustrated in FIGS. 2A through 2C, and is intended to be used in a manner identical to these units.

Referring to FIGS. 4A through 4D, the alternate attenuating unit 19 includes a substrate layer 46, made from the GGG material previously described, having a surface 48 metallized with a gold material 49 to form a first ground plane. A first YIG slab 50 is secured by suitable means to metallized surface 49. As known in the art, first YIG layer or slab 50 may be epitaxially grown on a GGG substrate layer, such as substrate layer 51, and thereafter GGG substrate layer 51 removed from YIG slab 50 after the slab 50 is secured to metallized surface 49. The steps for metallizing substrate layer 46 and attaching first YIG slab 50 thereto are sequentially illustrated in FIGS. 4A through 4D.

Figure 4A:
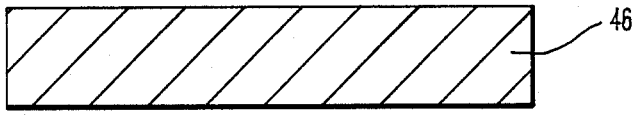
FIGS. 4A through 4I present a series of sectional views in side elevation of the sequence of steps for assembling another embodiment of a frequency selective limiting unit which forms a part of the frequency selective limiter device of FIG. 1.
Figure 4B:
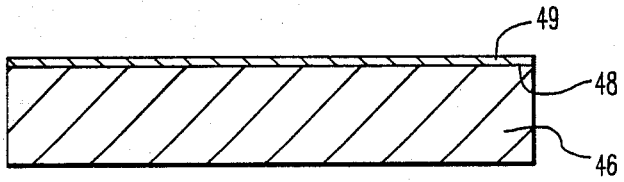
Figure 4C:
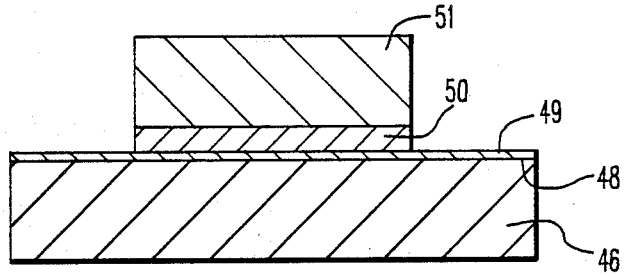
Figure 4D:
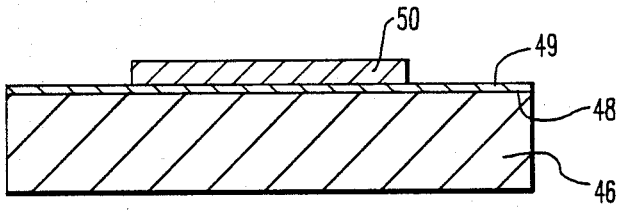
Figure 4E:
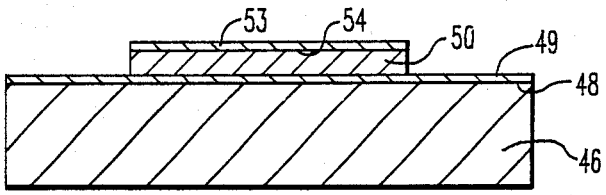
Figure 4F:
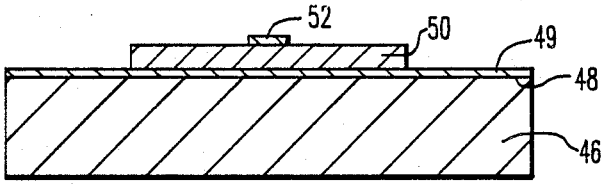

As seen in FIG. 4F, a signal-carrying conductor 52 is positioned on first YIG layer 50. Signal-carrying conductor 52 may either be formed photolithographically from a gas or other suitable material, which requires the step of first placing a metallized layer 53 on the surface 54 of first YIG layer 50 as illustrated in FIG. 4E; and thereafter etching the metallized layer to form the conductor 52. Although signal-carrying conductor 52 is illustrated and described in the Figures as being formed by a photolithographic process, it should be understood that conductor 52 may be formed by stretching a wire such as a gold bond wire or ribbon across the surface 54 of first YIG slab 50 if desired.

Figure 4G:
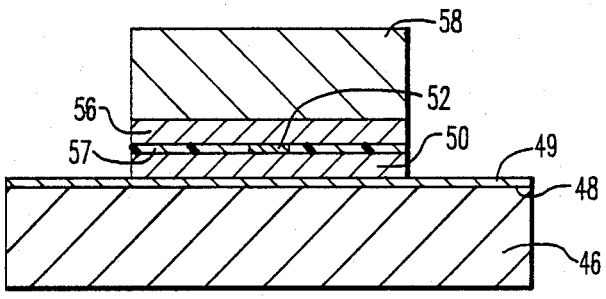
Figure 4H:
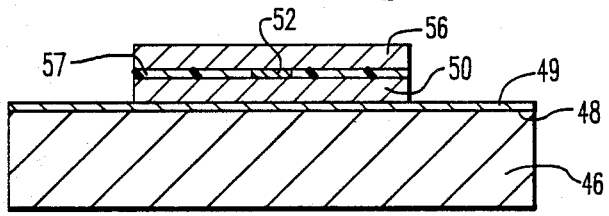
Figure 4I:
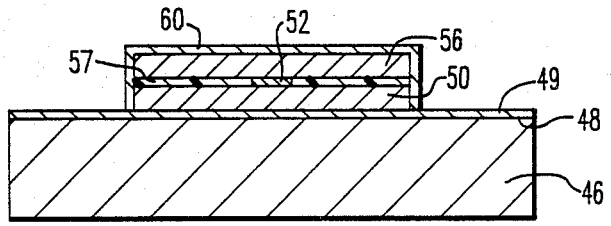

The attenuating unit 19 also includes a second YIG layer 56 secured with a suitable bonding material 57 to first YIG layer layer 50. As seen in FIGS. 4G and 4H, second YIG layer 56 is epitaxially grown on a third GGG substrate layer 58. After second YIG layer 56 is secured to first YIG layer 50 by means of bonding material 57, third GGG substrate layer 58 is ground off to provide an attenuating unit 19 having a configuration in sectional end view as illustrated in FIG. 4H. A metallic coating 60 is placed over first and second YIG layers 50, 56 to form a second ground plane. Both metallized layer 49 and metal coating 60 are formed from a gold material or other suitable material to surround a portion of attenuating unit 19 in an RF shield.

A portion of a fully assembled attenuating unit 19 is illustrated in perspective in FIG. 4J. As seen in FIG. 4J, conductor 52 is positioned between first and second YIG layers or slabs 50, 56, to provide that at least the body portion 53 of conductor 52 (shown in phantom) is encased in the YIG material. Both first and second YIG slabs 50, 56 have a generally planar configuration, and second YIG slab 56 ha an overall length less than the overall length of first YIG layer 50. As a result, the end portions 62 (one shown) of conductor 52 extend outwardly beyond the transverse edge portions 64 (one shown) of second YIG layer 56. With this arrangement, jumpers such as jumpers 38 previously described may be utilized to serially connect a plurality of attenuating units 19. As previously described, since first and second slabs 50, 56 are made from a YIG material, the thickness of each YIG slab may be varied to make the impedance of the signal-carrying conductor compatible with amplifiers and other external circuits. In addition, it has been found that increasing the thickness of the YIG slabs increases the level of attenuation per unit length of YIG material at a given power level above threshold power level.

Although the attenuating unit 19 illustrated in FIGS. 4A through 4J utilizes a signal-carrying conductor having a non-zero thickness to project from the surface 54 of first YIG slab 50, it should be understood that a channel or groove may be formed if desired in the surface 54 of first YIG slab 50 using a phosphoric acid etching process or other suitable groove-forming process. After formation, the groove may be metallized as previously described to form microstrip conductor 52.

Figure 3:
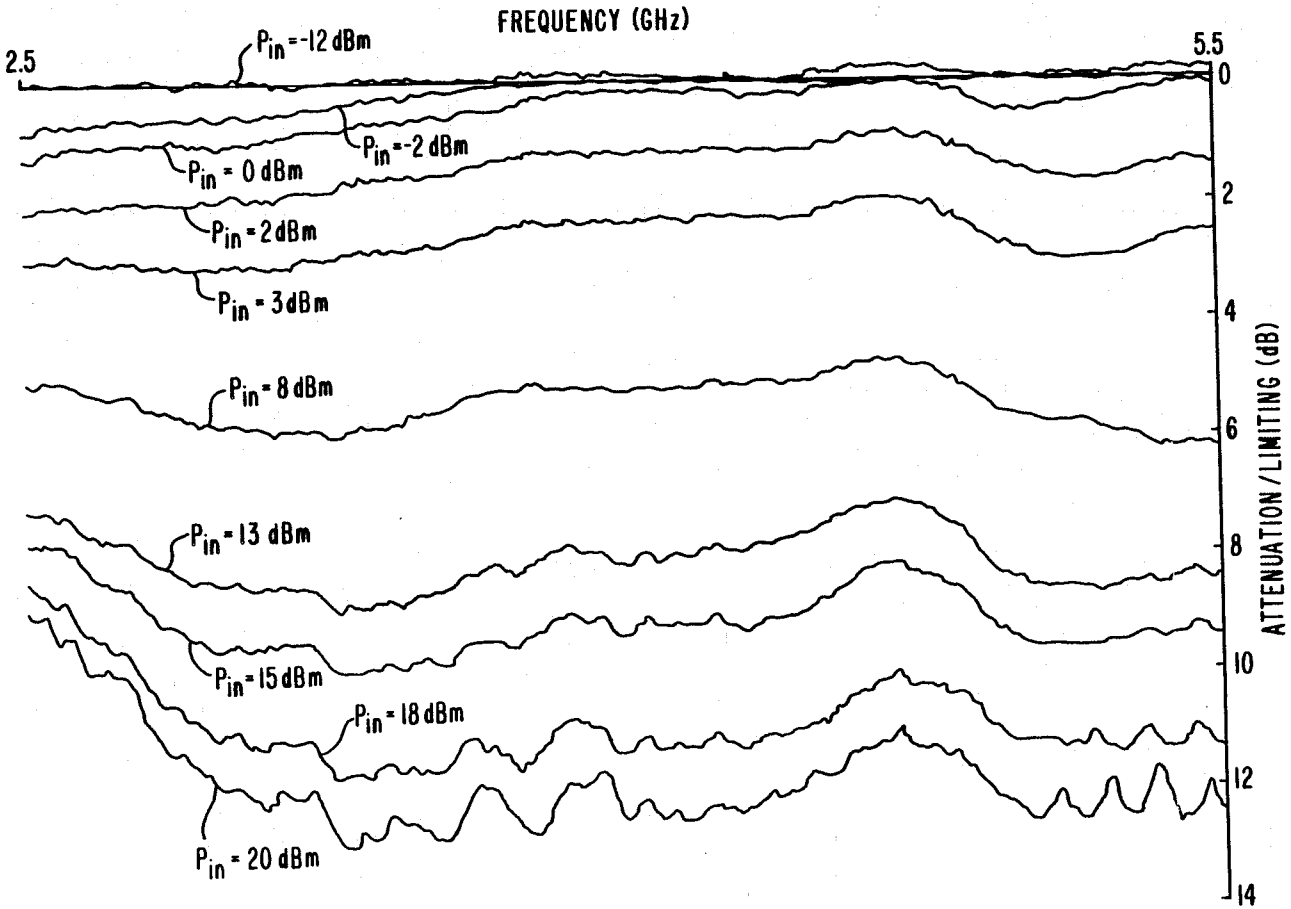
FIG. 3 illustrates a series of curves each plotting the amount of limiting or attenuation of a microwave signal as a function of the power of the signal relative to the threshold power level.

The plot of FIG. 3 illustrates the level of attenuation of ten individual microwave signals each having different $P_{in}$ values passed through FSL 16' illustrated in FIG. 2C. The measured frequency range of FSL 16' falls between approximately 2.5–5.5 GHZ, and the individual microwave signals have $P_{in}$ values ranging from −12 dBm to +20 dBm. As seen, the level of attenuation of a signal passed through FSL 16' increases as the value of $P_{in}$ increases. For example, a microwave signal having a $P_{in}$ value of 0 dBm is relatively undisturbed as it is passed through FSL 16'. while a microwave signal having a $P_{in}$ value of 20 dBm is attenuated by roughly 12–14 db.

As described, the attenuating units 18, 18', 18'' illustrated in FIGS. 2A through 2C and the attenuating unit 19 illustrated in FIG. 4J are both operable to attenuate a microwave signal having a power level above a predetermined threshold power level. Either attenuating units 18, 18' or 18'' or 19 illustrated in the Figures may be utilized in the FSL device 16' disclosed herein to provide a greater level of attenuation of microwave signals over both existing YIG-based FSL devices and other types of attenuating devices. The FSL device described herein has a configuration which allows more YIG material to be placed in contact with a signal-carrying conductor for a given unit length of conductor. This increases the RF coupling which takes place between the signal-carrying conductor and the YIG material as a microwave signal is passed through the conductor. This increased coupling provides a greater degree of attenuation of an above-threshold microwave per unit length of conductor.

It should be pointed out that although both the attenuating units 18, 18', 18'' of FIGS. 2A through 2C and the attenuating unit 19 of FIG. 4J have been described herein as being interposed between a pair of magnetic strips to form a part of attenuating device 16', these attenuating units may be independently used apart from device 16' to attenuate above-threshold microwave signals. However, if this is done, a DC magnet means must be provided to generate the DC bias field required for YIG-based attenuation.

Although the present invention has been described in terms of what are at present believed to be its preferred embodiments, it will be apparent to those skilled in the art that various changes may be made without departing from the scope of the invention. It is therefore intended that the appended claims cover such changes.

We claim:

1. An apparatus for attenuating microwave signals above a preselected power level passed therethrough comprising:

a plurality of individual attenuating units spaced from each other and positioned in substantially parallel relationship, said attenuating units all lying in substantially the same plane;

each said attenuating unit being formed from a signal-carrying conductor interposed between a layer of substrate material and a generally planar first ferrite member;

a plurality of magnetic strips, one said magnetic strip positioned in the space between a pair of adjacent, spaced-apart attenuating units to provide that each said attenuating unit is interposed between a pair of adjacent magnetic strips;

said plurality of attenuating units and said plurality of magnetic strips being interposed between a pair of spaced-apart ground planes;

means for connecting the signal-carrying conductors of said plurality of attenuating units so that said plurality of attenuating units are connected in serial relationship; and said plurality of ferrite members in association with said magnetic strips being operable to attenuate by a predetermined level a microwave signal above a preselected threshold power level passed through said plurality of serially connected attenuating units signal-carrying conductors.

2. An apparatus for attenuating microwave signals above a preselected power level passed therethrough as set forth in claim 1 wherein:

the level of attenuation of a microwave signal having a power level below said preselected threshold power level is substantially zero.

3. An apparatus for attenuating microwave signals above a preselected power level passed therethrough as set forth in claim 1 wherein:

said signal-carrying conductor in each said attenuating unit is positioned between and in contacting relation with said layer of substrate material and said generally planar first ferrite member.

4. An apparatus for attenuating microwave signals above a preselected power level passed therethrough as set forth in claim 1 wherein:

said plurality of signal-carrying conductors have substantially the same length.

5. An apparatus for attenuating microwave signals above a preselected power level passed therethrough as set forth in claim 1 wherein:

at least a portion of each said magnetic strip includes a metallic material;

each said magnetic strip provides at least a portion of a DC biasing field for a pair of attenuating units positioned at either side thereof; and each said magnetic strip also provides RF shielding between said pair of attenuating units.

6. An apparatus for attenuating microwave signals above a preselected power level passed therethrough as set forth in claim 1 wherein each said attenuating unit includes:

said signal-carrying conductor having a first surface and an opposite second surface, said planar first ferrite member secured to said first surface;

said substrate layer secured to said signal-carrying conductor second surface for mechanically supporting said first ferrite member and signal-carrying conductor; and said substrate layer being formed from a material having a thermal expansion coefficient substantially equal to the thermal expansion coefficient of said ferrite member.

7. An apparatus for attenuating microwave signals above a preselected power level passed therethrough as set forth in claim 1 wherein:

each said attenuating unit signal-carrying conductor has an input end portion and an output end portion; and an adjacent pair of attenuating units are serially connected by means of a signal-carrying jumper extending between the output end portion of one said conductor and the input end portion of said adjacent conductor.

8. An apparatus for attenuating microwave signals above a preselected power level passed therethrough as set forth in claim 7 wherein:

said signal-carrying conductor and said signal-carrying jumper are made from the same material.

9. An apparatus for attenuating microwave signals above a preselected power level passed therethrough as set forth in claim 7 which includes:

amplifier means having a preselected value of gain and connected in series with said signal-carrying jumper;

said amplifier means compensating for power losses experienced by said microwave signal as said signal is passed through an attenuating unit signal-carrying conductor; and said amplifier means establishing a preselected operating value of dynamic range for said adjacent pair of attenuating units.

10. An apparatus for attenuating microwave signals above a preselected power level passed therethrough as set forth in claim 7 wherein:

said signal-carrying jumper is mechanically supported by a dielectric substrate layer, said dielectric substrate layer being electrically isolated from said adjacent pair of attenuating units.

11. An apparatus for attenuating microwave signals above a preselected power level passed therethrough as set forth in claim 1 wherein:

each said attenuating unit further includes a generally planar second ferrite member interposed between said layer of substrate material and said signal-carrying conductor.

12. An apparatus for attenuating microwave signals above a preselected power level passed therethrough as set forth in claim 11 wherein:

each said attenuating unit first ferrite member has a length less than the lengths of said signal-carrying conductor and second ferrite member to expose an inlet and an outlet end portion of said signal-carrying conductor; and adjacent pairs of attenuating units being serially connected by means of a signal-carrying jumper extending between the exposed outlet end portion of one said attenuating unit conductor and the exposed inlet end portion of the other said attenuating unit conductor.

13. A frequency selective limiting unit operable to attenuate microwave signals above a preselected power level comprising:

a signal-carrying conductor for passing a microwave signal therethrough, said conductor having a pair of end portions and a body portion intermediate said end portions;

a ferrite covering positioned in surrounding relation with at least said signal-carrying conductor body portion;

said ferrite covering being formed from generally parallel first and second ferrite members, each said member having a generally rectangular configuration with said first member having a length less than the length of said second member;

said signal-carrying conductor being positioned between and secured to said first and second ferrite members, said conductor having a preselected length greater than said length of said first ferrite member and substantially equal to said length of said second ferrite member to expose said conductor end portions upon positioning said conductor between said first and second ferrite members;

said signal-carrying conductor being supported over its entire length by said second ferrite member;

RF shielding means surrounding said first and second ferrite members;

said signal-carrying conductor and said first and second ferrite members adapted to be positioned in preselected spatial relation with DC magnet means, said DC magnet means providing said first and second ferrite members with an external DC biasing magnetic field; and said DC magnet means in association with said ferrite covering being operable to attenuate by a predetermined level a microwave signal above a preselected threshold power level passed through said signal-carrying conductor.

14. The frequency selective limiting unit of claim 13 wherein:

at least one of said signal-carrying conductor exposed end portions is adapted to be connected with a signal-carrying jumper means for serially connecting said signal-carrying conductor with a signal-carrying conductor forming a portion of another frequency selective limiting unit.

15. The frequency selective limiting unit of claim 13 wherein:

said second ferrite member is mechanically supported by a substrate layer having a coefficient of thermal expansion substantially equal to the coefficient of thermal expansion of said second ferrite member.

16. The frequency selective limiting unit of claim 13 wherein:

said first and second ferrite members are made from a YIG material.

17. The frequency selective limiting unit of claim 13 wherein:

said signal-carrying conductor is made from a gold material.

18. The frequency selective limiting unit of claim 13 wherein:

said RF shielding means is made from a gold material.

19. A method for assembling a frequency selective limiting unit operable in association with external DC biasing means to attenuate microwave signals above a preselected power level comprising the steps of:

securing a generally planar second ferrite member to a metallized surface of a substrate layer;

disposing a generally linear signal-carrying conductor having a pair of opposing end portions and a center body portion on said second ferrite member, said signal-carrying conductor having a length substantially equal to the length of said second ferrite member;

disposing a generally planar first ferrite member having a length less than the lengths of said signal-carrying conductor and said second ferrite member on said signal-carrying conductor body portion;

positioning said first ferrite member on said signal-carrying conductor so that said conductor opposing end portions are exposed; and surrounding the outer surfaces of said first and said second ferrite members with a metallic material to enclose said first and said second ferrite members in an RF shield.

20. A method for assembling a frequency selective limiting unit as set forth in claim 19 including:

providing said substrate layer having a thermal expansion coefficient substantially equal to a thermal expansion coefficient of said first and said second ferrite members.

* * * * *